US009045199B2

(12) United States Patent
Van Hoeken

(10) Patent No.: US 9,045,199 B2
(45) Date of Patent: Jun. 2, 2015

(54) FLUID TRANSFER ASSEMBLY

(75) Inventor: Allard Pieter Van Hoeken, Amsterdam (NL)

(73) Assignee: Bluewater Energy Services B.V., Hoofddorp (NL)

( * ) Notice: Subject to any disclaimer, the term of this patent is extended or adjusted under 35 U.S.C. 154(b) by 1309 days.

(21) Appl. No.: 12/738,888

(22) PCT Filed: Oct. 22, 2007

(86) PCT No.: PCT/EP2007/061285
§ 371 (c)(1),
(2), (4) Date: Jul. 26, 2010

(87) PCT Pub. No.: WO2009/052853
PCT Pub. Date: Apr. 30, 2009

(65) Prior Publication Data
US 2010/0279561 A1 Nov. 4, 2010

(51) Int. Cl.
*B65B 1/04* (2006.01)
*B63B 27/24* (2006.01)

(52) U.S. Cl.
CPC ..... *B63B 27/24* (2013.01)

(58) Field of Classification Search
CPC ..... B63B 27/24–27/25; B63B 27/30–27/34; B67D 9/02; B63H 25/42
USPC ..... 137/236.1, 615; 141/279, 363, 382, 141/383, 384, 387, 388; 441/4, 5
See application file for complete search history.

(56) References Cited

U.S. PATENT DOCUMENTS 3,595,195 A * 7/1971 Van Eek et al. ..... 441/4
3,741,264 A * 6/1973 Kinoshita ..... 141/383
3,750,749 A * 8/1973 Giroux ..... 166/95.1
3,833,032 A * 9/1974 Hnot ..... 141/232
3,921,684 A * 11/1975 Allen ..... 141/279
4,205,379 A * 5/1980 Fox et al. ..... 701/116
4,211,281 A * 7/1980 Lawson ..... 166/345

(Continued)

FOREIGN PATENT DOCUMENTS

WO WO 96/14238 11/1995
WO WO 02/098726 6/2001

OTHER PUBLICATIONS

International Search Report of the European Patent Office Patent Office in counterpart foreign application No. PCT/EP2007/061285 filed Oct. 22, 2007.

(Continued)

*Primary Examiner* — Timothy L Maust
(74) *Attorney, Agent, or Firm* — Steven M. Koehler; Westman, Champlin & Koehler, P.A.

(57) ABSTRACT

A fluid transfer assembly for transferring a fluid between an onshore or offshore installation and a tanker, includes a floating device provided with positioning means for maintaining a predetermined position, a first fluid transfer line for releasably connecting said onshore or offshore installation to said floating device, and a second fluid transfer line for releasably connecting said floating device to the tanker. The floating device is provided with a connecting device for establishing a fluid connection between the first and second fluid transfer lines, which connecting device and floating device are separate parts that can be joined and separated by cooperating couplers provided on the connecting device and floating device, respectively, without compromising the original function of the floating device.

19 Claims, 2 Drawing Sheets

(56) References Cited

U.S. PATENT DOCUMENTS

| | | | | | |
|---|---|---|---|---|---|
| RE32,578 | E | * | 1/1988 | Poldervaart et al. | 441/5 |
| 4,735,167 | A | * | 4/1988 | White et al. | 114/230.14 |
| 4,741,716 | A | * | 5/1988 | Hasebe et al. | 441/4 |
| 5,065,687 | A | * | 11/1991 | Hampton | 441/4 |
| 5,284,452 | A | * | 2/1994 | Corona | 441/3 |
| 5,529,521 | A | * | 6/1996 | Breivik et al. | 441/5 |
| 5,564,957 | A | * | 10/1996 | Breivik et al. | 441/5 |
| 5,803,779 | A | * | 9/1998 | Horton, III | 441/4 |
| 5,816,183 | A | * | 10/1998 | Braud et al. | 114/230.13 |
| 5,893,333 | A | * | 4/1999 | Smedal | 114/230.2 |
| 5,927,902 | A | * | 7/1999 | Sveen et al. | 405/169 |
| 6,321,844 | B1 | * | 11/2001 | Thiebaud et al. | 166/345 |
| 6,485,343 | B1 | * | 11/2002 | Børseth | 441/4 |
| 6,503,112 | B1 | * | 1/2003 | Chadwick et al. | 441/3 |
| 6,736,082 | B2 | * | 5/2004 | Breivik et al. | 114/230.1 |
| 6,763,862 | B2 | * | 7/2004 | Fontenot et al. | 141/387 |
| 6,817,914 | B2 | * | 11/2004 | Breivik | 441/4 |
| 6,932,127 | B2 | * | 8/2005 | Samuelsen et al. | 141/387 |
| 6,976,443 | B2 | * | 12/2005 | Oma et al. | 114/144 B |
| 7,543,613 | B2 | * | 6/2009 | Adkins et al. | 141/231 |
| 7,614,927 | B2 | * | 11/2009 | Olsen et al. | 441/5 |
| 8,231,420 | B2 | * | 7/2012 | Lunde | 441/5 |
| 2004/0099337 | A1 | * | 5/2004 | Hilden et al. | 141/387 |
| 2004/0211485 | A1 | | 10/2004 | Samuelsen | |
| 2004/0261681 | A1 | | 12/2004 | Jordanger | |
| 2009/0205343 | A1 | * | 8/2009 | Dupont et al. | 62/50.7 |

OTHER PUBLICATIONS

Written Opinion of the European Patent Office Patent Office in counterpart foreign application No. PCT/EP2007/061285 filed Oct. 22, 2007.

* cited by examiner

FLUID TRANSFER ASSEMBLY

CROSS-REFERENCE TO RELATED APPLICATION

The present application is a national stage filing of International patent application Serial No. PCT/EP2007/061285, filed Oct. 22, 2007, and published as WO 2009/052853 in English.

BACKGROUND

The discussion below is merely provided for general background information and is not intended to be used as an aid in determining the scope of the claimed subject matter.

A fluid transfer assembly is used for transferring a fluid between an onshore or offshore installation and a tanker.

For example, such a fluid transfer assembly is used to transfer oil or gas from an offshore production installation towards a tanker.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

Thus, in accordance with a first aspect of the invention, the fluid transfer assembly comprises a floating device provided with positioning device for maintaining a predetermined position; a first fluid transfer line for releasably connecting said onshore or offshore installation to said floating device, and a second fluid transfer line for releasably connecting said floating device to the tanker, wherein the floating device is provided with a connecting device for establishing a fluid connection between the first and second fluid transfer lines, which connecting device and floating device are separate parts that can be joined and separated by a cooperating coupler provided on the connecting device and floating device, respectively, without compromising the original function of the floating device.

The connecting device and floating device being separate parts allows the use of non-dedicated floating devices (in contrast to floating devices specifically designed for such a task, such as for example vessels provided with a turret, turntable and/or moonpool) in combination with the connecting device. For example, when severe damage has occurred to existing state of the art fluid transfer assemblies due to extreme weather conditions (e.g. hurricanes) the fluid transfer capability from an offshore oil or gas field towards a tanker (or shore) may be (re)-established quickly by coupling a connecting device with a floating device (for example a towboat, platform supply vessel or anchor handling vessel) at hand at said specific location.

In one embodiment the connecting device comprises an intermediate fluid transfer line mounted in a frame, said intermediate fluid transfer line having a first end provided with a first connector for cooperation with a corresponding connector of the first fluid transfer line, and having a second end provided with a second connector for cooperation with a corresponding connector of the second fluid transfer line.

When the connecting device is coupled to the floating device, connecting the fluid transfer lines thereto allows one to establish the desired fluid transfer capability in a simple manner.

Further, then, it is preferred in one embodiment that the first connector of the connecting device and the corresponding connector of the first fluid transfer line define a rotating coupling allowing the floating device to rotate around said coupling relative to the first fluid transfer line.

Such a rotating coupling allows the floating device to weathervane such as to assume a position in which environmental loads (e.g. arising from current, waves or wind) are minimized, while maintaining the desired fluid transfer capability. Generally, in such a case, the tanker will move (rotate) along with the floating device, substantially maintaining its position relative thereto. The rotation may occur without angular limitation.

When, in accordance with an embodiment of the fluid transfer assembly according to the present invention the connecting device is positionable relative to the floating device such, that the first and second fluid lines, when connected to the intermediate fluid transfer line, extend outboard of the floating device, indeed the connecting device may be used in combination with a non-dedicated floating device without the need of extensively amending or adapting the floating device. Only quite simple provisions are needed, such as a coupler for cooperation with a coupler of the connecting device. One should realize, however, that apart from these mechanical couplers also provisions may be present for realizing a connection for hydraulic power, electrical power etc.

When, in accordance with yet another embodiment, the end of the first fluid transfer line to be connected to the connecting device is provided with a buoy member, the first fluid transfer line may be disconnected from the connecting device (whenever the need arises) and may be reconnected easily at a later stage by picking up the buoy member floating in the water (it is noted that the buoyancy of the buoy member may cause the respective end of the first fluid transfer line to actually float on the water, but also may be such that it floats at some distance below the water surface).

In one embodiment, the positioning device of the floating device can comprise thrusters. This eliminates the use of anchored mooring lines.

For example the positioner further may comprise a position monitoring system (e.g. a gps-based system) providing control signals for the thrusters, thus creating a dynamically positioned arrangement.

Secondly an aspect of the invention relates to a retrofittable connecting device for application in a fluid transfer assembly. Such a connecting device comprises an intermediate fluid transfer line, said intermediate fluid transfer line having a first end provided with a first connector for cooperation with a corresponding connector of the first fluid transfer line, and having a second end provided with a second connector for cooperation with a corresponding connector of the second fluid transfer line, and further comprises a coupler for cooperation with a corresponding coupler on a floating device for joining and separating the connecting device and said floating device.

Finally an aspect of the invention relates to a kit for establishing a fluid transfer connection between an onshore or offshore installation and a tanker. Such a kit comprises a first fluid transfer line with a distal end for connection to said onshore or offshore installation and with a proximal end, a second fluid transfer line with a distal end for connection to said tanker and with a proximal end, and a connecting device which can be connected releasably to the proximal ends of said first and second fluid transfer lines for establishing a fluid connection therebetween, which connecting device further can be joined to and separated from a floating device.

BRIEF DESCRIPTION OF THE DRAWINGS

Aspects of the invention will be elucidated while referring to the drawing in which.

DETAILED DESCRIPTION OF THE ILLUSTRATIVE EMBODIMENT

Figure 1:
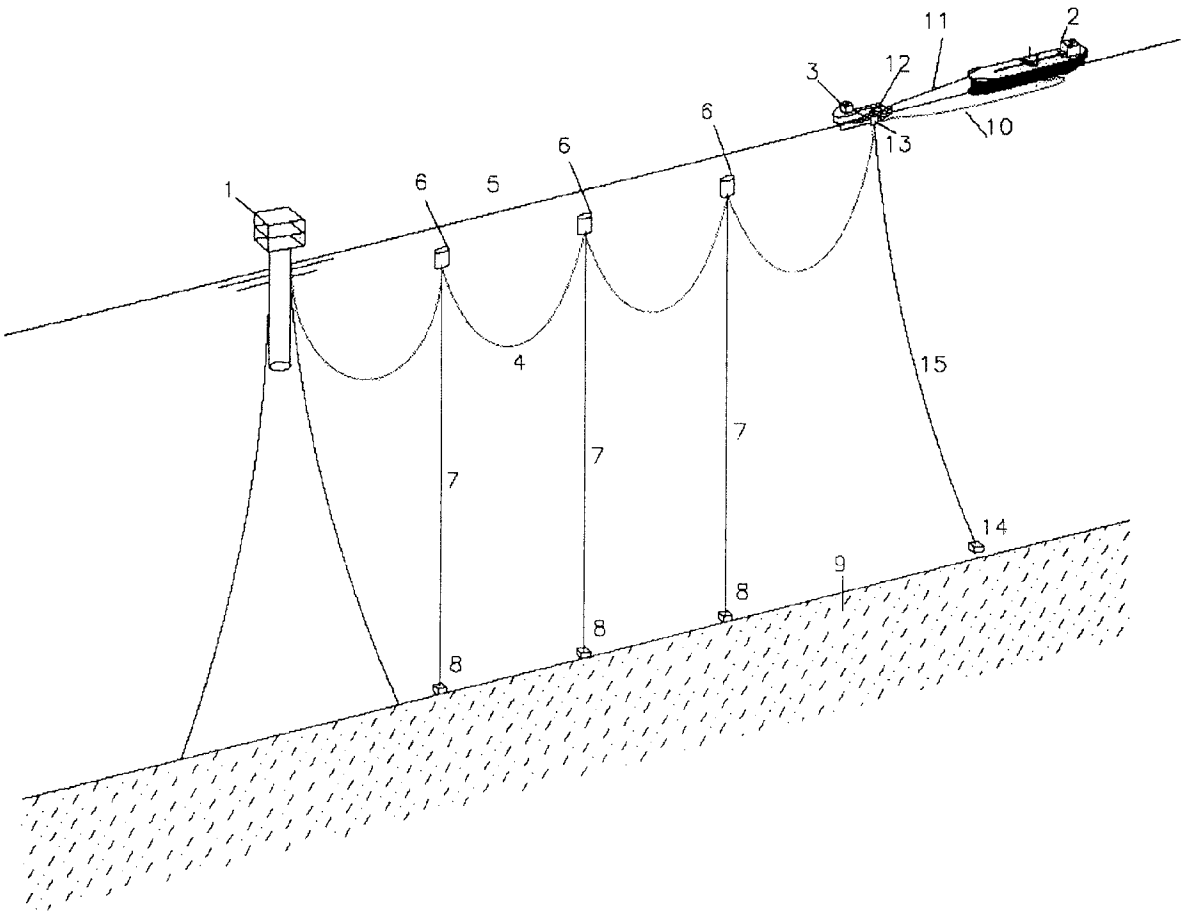
FIG. 1 illustrates schematically an embodiment of a fluid transfer assembly used in deep water, in a side elevational view.

Firstly referring to FIG. 1 a fluid transfer assembly is illustrated for transferring a fluid from an offshore installation (such as for example an oil production installation 1) to a tanker 2. It is noted that instead of an offshore installation also an onshore installation may be present as starting point for the transfer of the fluid. Further it is noted that the tanker 2 may be connected to a towboat for keeping its correct position and preloading on a hawser connection (to be described later). The tanker 2 also may be used as a facility for temporarily storing the fluid, alone or in combination with an additional tanker.

A floating device, here a vessel 3, is provided with a positioner 30 for maintaining a predetermined position. In one embodiment, the vessel 3 preferably is a non-dedicated vessel, that means a vessel devised originally for a task different from transferring fluid such as for example a towboat. In the present embodiment the positioner 30 for maintaining a predetermined position are meant for maintaining the position of the vessel 3 relative to the offshore installation 1; it does not mean that the orientation of the vessel 3 is maintained (specifically, as will be elucidated later, the vessel will be able to rotate or 'weathervane' around a stationary point). In one embodiment, said positioner can comprise thrusters 31 (schematically illustrated) controlled by a position monitoring system 32 (e.g. a gps-based system) and a control system 33.

The assembly further comprises a first fluid transfer line 4 for releasably connecting said offshore installation 1 to said vessel 3. In the illustrated embodiment said first fluid line 4 extends below sea level 5 and comprises a number of successive sections between buoy members 6. The buoy members 6 are attached to anchoring lines 7 which, in the illustrated embodiment, are connected to ballast weights 8 resting on the sea floor 9. It is noted that it also is conceivable that the first fluid transfer line 4 extends at least partially above sea level 5.

The first fluid transfer line 4 has a distal end connected for a fluid communication to the installation 1 in a manner not shown in detail, but known per se, and an opposite proximal end connected for a fluid communication to the vessel 3 in a manner detailed later.

A second fluid transfer line 10 is provided for releasably connecting said vessel 3 to the tanker 2. In the illustrated embodiment said second fluid transfer line 10 is of a type floating on the water surface. The second fluid transfer line 10 has a distal end connected for a fluid communication to an appropriate installation on board of the tanker 2 in a manner not shown in detail, but known per se, and an opposite proximal end connected for a fluid communication to the vessel 3 in a manner detailed later.

Moreover, as is known per se, a hawser connection 11 connects the vessel 3 with the tanker 2. Some devices for manipulating this hawser connection 11 (such as, for example, a reel) are not shown in detail, but are known per se. The hawser connection 11 may be of a quick-disconnect type and/or be provided with a load monitoring system 34 providing signals for the control system of the vessel 3 (e.g. the control system 33 controlling the thrusters 31).

The vessel 3 is provided with a connecting device 12 for establishing a fluid connection between the first fluid transfer line 4 and the second fluid transfer line 10, specifically between the proximal ends thereof. Details of the connecting device will be elucidated below while referring to FIG. 2.

The proximal end of the first fluid transfer line 4 to be connected to the vessel 3 for example with a buoy member 13. In the illustrated embodiment this buoy member 13 is connected to a ballast weight (or other anchoring devices) 14 on the sea floor 9 by means of an anchoring line 15. The buoy member 13 will keep the proximal end of the first fluid transfer line afloat (or at e pre-determined depth) when detached from the vessel 3 (for example when, due to bad weather conditions—hurricanes—the vessel 3 and tanker 2 will have to leave the area), which will enable an easy pick-up of said proximal end at a later stage for re-instating the connection with the vessel.

Figure 2:
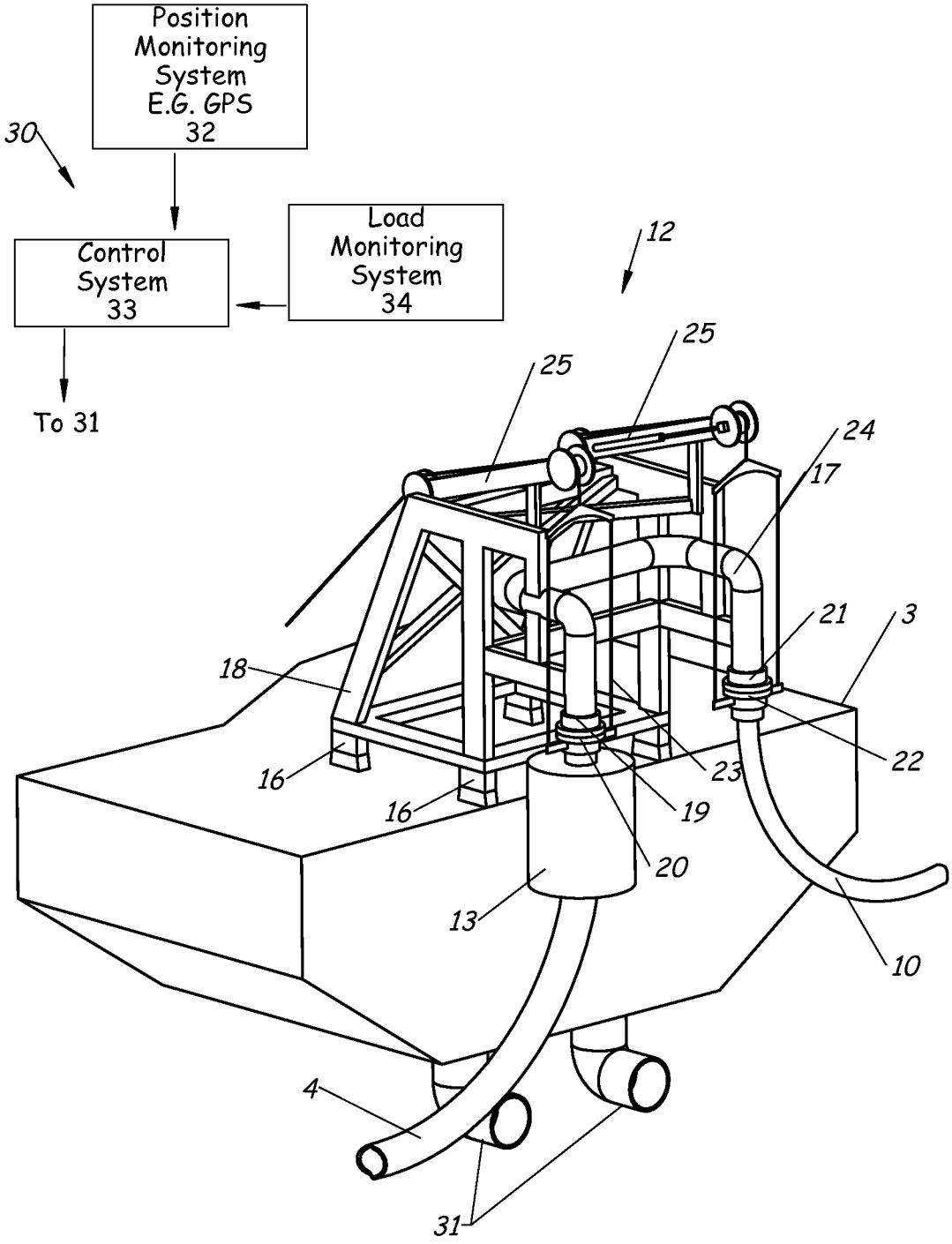
FIG. 2 illustrates, on a larger scale, a schematical perspective view of a connector.

Next, reference is made to FIG. 2 which, on a larger scale and schematically, illustrates a possible embodiment of the connection device 12 shown in FIG. 1.

Firstly it should be emphasized that the connecting device 12 and vessel 3 (latter not shown in FIG. 2) are separate parts that can be joined and separated. Separate parts means, therefore, that the connecting device 12 can be removed from the vessel 3 without compromising the original function of the vessel 3 (this could mean also, without damaging the vessel 3 and/or connecting device 12). Or in other words, there are provided couplers on the connecting device 12 and vessel 3, respectively, which allow a repeated connection and disconnection of both parts. Such parts are indicated schematically at 16 in FIG. 2.

The connecting device 12 comprises an intermediate fluid transfer line 17 mounted in a frame 18. Additional means such as valves, dry break (dis)connectors etc. are not shown in detail, but may be provided too. Said intermediate fluid transfer line 17 has a first end provided with a first connector 19 for cooperation with a corresponding connector 20 of the first fluid transfer line 4, and has a second end provided with a second connector 21 for cooperation with a corresponding connector of the second fluid transfer line 10.

The first connector 19 of the connecting device 12 and the corresponding connector 20 of the first fluid transfer line 4 define a rotating coupling allowing the vessel 3 to rotate ('weathervane') around said coupling relative to the first fluid transfer line 4. Referring to what has been noted previously, one can say that the vessel 3 has a stationary position but variable orientation relative to said rotating coupling. In other words, the rotating coupling defines a substantially vertical axis around which the vessel 3 (and therewith the tanker 2) may rotate.

Connectors for establishing such a rotating coupling are known per se and are not further elucidated here. They may be quick-disconnectable.

In the illustrated embodiment the second connector 21 of the connecting device 12 and the corresponding connector 22 of the second fluid transfer line 10 define a stationary coupling; however it is conceivable too that said coupling also can rotate at least in a limited way. These devices may be quick-disconnectable too.

In the embodiment as illustrated, the frame 18 is provided with a lifting assembly herein lifters 23 and 24 for lifting ends of the first and second fluid transfer lines. Such lifters 23 and 24 (which, for example, may comprise outriggers 25, a winch and lifting cables) will be devised for enabling an easy and quick pick-up and, if needed, controlled release of the lines 4 and 10, whatever the case may be. A separate frame with winch and power pack also may be used.

The connecting device 12, or specifically its frame 18, is positionable relative to the vessel 3 such, that the first and second fluid lines 4 and 10, when connected to the intermediate fluid transfer line 17, extend outboard of the vessel 3. This may be achieved by means of the outriggers 25, for example.

A connecting device 12 may be kept in storage (onshore or offshore). When, for instance, an existing fluid export capability has been compromised or an existing fluid transfer assembly has been damaged (for example by a hurricane) the connection device 12 can be retrofitted to a vessel 3, such as a towboat which needs only minimum adaptations, i.e. couplers 16 for attaching the connecting device 12 to the deck of the vessel 3. As a result the fluid transfer capability can be re-instated in a quick manner. The fluid transfer assembly thus created may be used on a temporary basis, but may also be used during a prolonged time. Further its use may be temporarily interrupted (for example for maneuvering the vessel 3 with tanker 2 out of the path of an arriving hurricane) by disconnecting the first and possibly second fluid transfer lines 4, 10 from the connecting device 12. At a later stage a reconnection may be established.

However, not only may a connection device 12 as stated above be kept in storage, but also a kit for establishing a fluid transfer connection between an onshore or offshore installation and a tanker 2, comprising a first fluid transfer line 4, a second fluid transfer line 10, and connectors 19, 21 which can be connected releasably to the proximal ends of said first and second fluid transfer lines 4, 10 for establishing a fluid connection therebetween.

The invention is not limited to the embodiments described before which may be varied widely within the scope of the invention as defined by the appending claims. For example, the vessel 3 may have (interim) storage capabilities. Further it is possible, that the couplings described above define quick-disconnectable couplings, that is couplings that can be disconnected in a very short time.

The invention claimed is:

1. A fluid transfer assembly for transferring a fluid between an onshore or offshore installation and a tanker, comprising:

a floating device provided with a positioner configured to maintain a predetermined position;

a first fluid transfer line for releasably connecting said onshore or offshore installation to said floating device, and a second fluid transfer line for releasably connecting said floating device to the tanker, wherein the floating device is provided with a connecting device having an intermediate fluid transfer line fixedly mounted to a frame for establishing a fluid connection between the first and second fluid transfer lines, the intermediate fluid transfer line having two fluidly coupled ends, the first and second fluid transfer lines being directly couplable to the ends of the intermediate fluid transfer line with quick-disconnectable couplings, and wherein the connecting device and floating device are separate parts configured to be joined and separated by cooperating couplers provided on the connecting device and floating device, respectively, the connecting device being removable as a unit from the floating device through the couplers that couple the frame to the floating device, wherein said ends of said intermediate fluid transfer line comprise a first end provided with a first connector for cooperation with a corresponding connector of the first fluid transfer line, and a second end provided with a second connector for cooperation with a corresponding connector of the second fluid transfer line, and wherein the frame is provided with a lifting assembly configured to lift ends of the first and second fluid transfer lines.

2. The fluid transfer assembly according to claim 1, wherein the first connector of the connecting device and the corresponding connector of the first fluid transfer line define a rotating coupling allowing the floating device to rotate around said coupling relative to the first fluid transfer line.

3. The fluid transfer assembly according to claim 1, wherein the first connector of the connecting device and the corresponding connector of the first fluid transfer line define the quick-disconnectable coupling.

4. The fluid transfer assembly according to claim 1, wherein the second connector of the connecting device and the corresponding connector of the second fluid transfer line define a stationary coupling.

5. The fluid transfer assembly according to claim 1, wherein the second connector of the connecting device and the corresponding connector of the second fluid transfer line define the quick-disconnectable coupling.

6. The fluid transfer assembly according to claim 1, wherein the connecting device is positionable relative to the floating device such that the first and second fluid transfer lines, when connected to the intermediate fluid transfer line, extend substantially entirely outboard of the floating device.

7. The fluid transfer assembly according to claim 1, wherein the end of the first fluid transfer line to be connected to the connecting device is provided with a buoy member.

8. The fluid transfer assembly according to claim 1, wherein the positioner comprises thrusters and a position monitoring system providing control signals for the thrusters.

9. The fluid transfer assembly according to claim 1, wherein the connecting device and floating device are configured to be joined and separated by the cooperating couplers without compromising the original function of the floating device.

10. The fluid transfer assembly according to claim 1, further comprising a hawser connection between the floating device and the tanker.

11. The fluid transfer assembly according to claim 10, wherein the hawser connection is provided with a load monitoring system for monitoring the stress load on the hawser connection.

12. The fluid transfer assembly according to claim 10, wherein the hawser connection is quick-disconnectable.

13. A retrofittable connecting device for application in a fluid transfer assembly, comprising:

a frame;

an intermediate fluid transfer line fixedly mounted to the frame, said intermediate fluid transfer line having a first end provided with a first connector for cooperation with a corresponding connector of a first fluid transfer line, and having a second end provided with a second connector for cooperation with a corresponding connector of a second fluid transfer line, wherein the first connector and the corresponding connector of the first fluid transfer line and the second connector and the corresponding connector of the second fluid transfer line each comprise a quick- disconnectable coupling;

couplers for cooperation with corresponding couplers on a floating device for joining and separating the connecting device and said floating device, the connecting device being removable as a unit from the floating device through the couplers that couple the frame to the floating device; and wherein the corresponding connectors of the first and second fluid transfer lines are directly couplable to the first and second ends of the intermediate fluid transfer lines, and wherein the frame is provided with a lifting assembly configured to lift ends of the first and second fluid transfer lines.

14. The connecting device according to claim 13, wherein the first connector is configured to define a rotating coupling with the corresponding connector of the first fluid transfer line allowing the floating device to rotate around said coupling relative to the first fluid transfer line.

15. The connecting device according to claim 13, wherein the second connector is configured to define a stationary coupling with the corresponding connector of the second fluid transfer line.

16. The connecting device according to claim 13, wherein the connecting device is positionable relative to the floating device such that the first and second fluid transfer lines, when connected to the intermediate fluid transfer line, extend entirely outboard of the floating device.

17. A connecting device for establishing a fluid transfer connection between an onshore or offshore installation and a tanker, the connecting device configured to be connected with quick-disconnectable couplings releasably to proximal ends of fluid transfer lines for establishing a fluid connection therebetween, which connecting device further is configured to be joined to and separated from a floating device, the connecting device comprising couplers configured to secure the connecting device to the floating device such that substantially all the weight of the connecting device is supported by the floating device; an intermediate fluid transfer line having first and second ends provided with first and second connectors, respectively, for cooperation with corresponding connectors of the fluid transfer lines, respectively; a first fluid transfer line with a distal end for connection to said onshore or offshore installation and with a proximal end having a connector connected to the first connector; a second fluid transfer line with a distal end for connection to said tanker and with a proximal end having a connector connected to the second connector; and a lifting assembly configured to lift ends of the first and second fluid transfer lines.

18. The connecting device according to claim 17, wherein the intermediate fluid transfer line is mounted in a frame and wherein said frame is provided with the couplers for cooperation with corresponding couplers on said floating device such that substantially all the weight of the connecting device is supported through the frame.

19. The connecting device according to claim 17, wherein the first connector and the corresponding connector of the first fluid transfer line define a rotating coupling allowing the connecting device to rotate around said coupling relative to the first fluid transfer line.

* * * * *